US005361822A

United States Patent [19]

Nijs

[11] Patent Number: 5,361,822

[45] Date of Patent: Nov. 8, 1994

[54] SHADE OPERATOR

[75] Inventor: Frederik G. J. Nijs, Calgary, Canada

[73] Assignee: Nysan Shading Systems Ltd., Calgary, Canada

[21] Appl. No.: 177,141

[22] Filed: Jan. 4, 1994

[51] Int. Cl.[5] ..... E06B 9/56

[52] U.S. Cl. ..... 160/321; 160/298

[58] Field of Search ..... 160/321, 307, 298, 291, 160/319

[56] References Cited

U.S. PATENT DOCUMENTS

| | | | |
|---|---|---|---|
| Re. 31,793 | 1/1985 | Berman et al. . | |
| 1,841,384 | 1/1932 | Schmelz | 160/307 X |
| 4,223,714 | 9/1980 | Weinreich et al. . | |
| 4,498,517 | 2/1985 | Mase . | |
| 4,779,662 | 10/1988 | Wilk . | |

*Primary Examiner*—Blair M. Johnson

[57] ABSTRACT

An operator for a window or like shade serves to turn a shade roller to a new desired position as the result of a torque applied from a manually operable source, such as a chain operated wheel. The device includes a helical spring that is seated within a fixed bushing with its outer surface in contact with an inner cylindrical surface of the bushing. When torque is applied from the manually operable source, one overlapping end of the spring is moved away its other end to reduce the spring diameter and hence release any frictional engagement of the spring with the bushing, thus allowing the torque to rotate the spring, which rotation is transmitted to the roller. However, when no such manually applied torque is present, the spring and the roller remain effectively locked in position. Any torque applied from the roller due to the weight of a partly lowered shade acts to tend to increase the spring diameter and thus to ensure a binding frictional engagement between the bushing and the spring.

3 Claims, 3 Drawing Sheets

SHADE OPERATOR

FIELD OF THE INVENTION

The present invention relates to a shade operator, that is to say a device for operating and positioning a window or like shade. More specifically, the device, which is manually operable to position the shade in any desired position, also incorporates a mechanism that maintains the shade roller in the position in which it has been set notwithstanding any downward force exerted by the weight of the shade, for example, if the shade is in a halfway down position. This maintenance of the shade in its set position against a torque exerted by the weight of the shade can, however, always be readily and simply overridden by the user, whenever it is desired to change the position of the shade.

PRIOR ART

Mechanisms serving this purpose are already known, and, in particular, reference is made to J. Wilk U.S. Pat. No. 4,779,662 issued Oct. 25, 1988. This patent discloses a shade operator that employs a helical spring that surrounds a central stud and is dimensioned to grip the stud frictionally. The weight of a partially unrolled shade is transferred to the ends of this spring in such a manner as to tighten it on the stud and hence increase the frictional grip that maintains the shade roller in its set position. When the user employs a ball chain or other operating device to change the position of the roller, the force exerted by the user is transferred to the spring in such a manner as to flex it open, i.e. increase its diameter slightly. This increase of diameter is sufficient to release the frictional grip of the spring on the central stud and hence allow the spring, and with it the roller, to rotate to a new position under the control of the user. Upon release of the user-applied force flexing the spring, the spring relaxes to its normal condition in which it grips the central stud and resists any torque applied by the roller.

SUMMARY OF THE INVENTION

The preferred form of the present invention provides an improved version of this Wilk construction, and, in particular, a system in which the helical spring is located inside a fixed cylindrical bushing, against which it expands outwardly when in its relaxed condition. When the user applies an operating force for rotating the roller and hence changing the position of the shade, this force is also applied to the spring to decrease its diameter and hence release any frictional grip that it has on the bushing that surrounds it.

More specifically, the invention consists of a shade operator comprising a support structure and a bushing secured to this structure, the bushing having an inner cylindrical surface defining a longitudinal axis. A helical spring is coaxially located within the bushing and has a substantially cylindrical outer surface of such diameter as to be in contact with the inner surface of the bushing. The spring has a pair of opposite ends circumferentially movable relatively to each other selectively either to decrease or to tend to increase the diameter of the spring. Manually operable means can exert a torque on the spring about the longitudinal axis and simultaneously act on a spring end to decrease the spring diameter and hence avoid frictional resistance by the bushing to rotation of the spring. Also provided is means for connecting a shade roller to the spring to rotate therewith upon operation of the manually operable means. This connecting means further includes means responsive to a torque from the roller for acting on a spring end to tend to increase the spring diameter to establish a frictional resistance by the bushing to rotation of the spring and hence of the connecting means and the roller.

In the preferred form of the invention each spring end has a projection extending inwardly into a generally cylindrical cavity within the spring, the projections overlapping each other circumferentially to define a circumferentially extending space between them that also extends longitudinal of the spring. The manually operable means includes an operating member that surrounds the bushing and is rotatable about the axis of the bushing. A link has a first arm connected to the operating member and a second arm extending into the space between the projections whereby rotation of the operating member in either direction will cause this second arm to act on one of the projections to move it away from the other projection to decrease the spring diameter and simultaneously transmit torque to the spring from the operating member to rotate the spring and hence the connecting means and the roller.

Also in the preferred form of the invention the support structure includes a cylindrical post extending along the axis defined by the spring, and the connecting means is mounted for rotation on this post. The connecting means has surfaces for engaging respective ones of the projections so that rotation of the connecting means in either direction will cause one of these surfaces to act on an adjacent projection to tend to move it towards the other projection and hence tend to increase the spring diameter and establish binding frictional resistance between the bushing and the spring.

This arrangement differs fundamentally from the Wilk construction in that in the present construction it is the outer, substantially cylindrical surface defined by contiguous convolutions of the helical spring that provides the gripping engagement with the inside surface of a fixed cylindrical bushing surrounding the spring. This use of the outer surface of the spring as the gripping surface, in contrast to the inner spring surface that performs a somewhat similar function in the Wilk construction, has the advantage that for a given spring size the area available for frictional contact is larger; or alternatively, for the same degree of frictional contact, the spring can be of smaller diameter, or smaller length, or both.

In addition to this advantage of improved operation, the preferred embodiment of the present invention, which is described in more detail below and illustrated in the drawings, will be seen to have structural aspects that render it simpler, and hence easier and cheaper to manufacture, than the Wilk construction.

DETAILED DESCRIPTION OF THE PREFERRED EMBODIMENT

Figure 1:
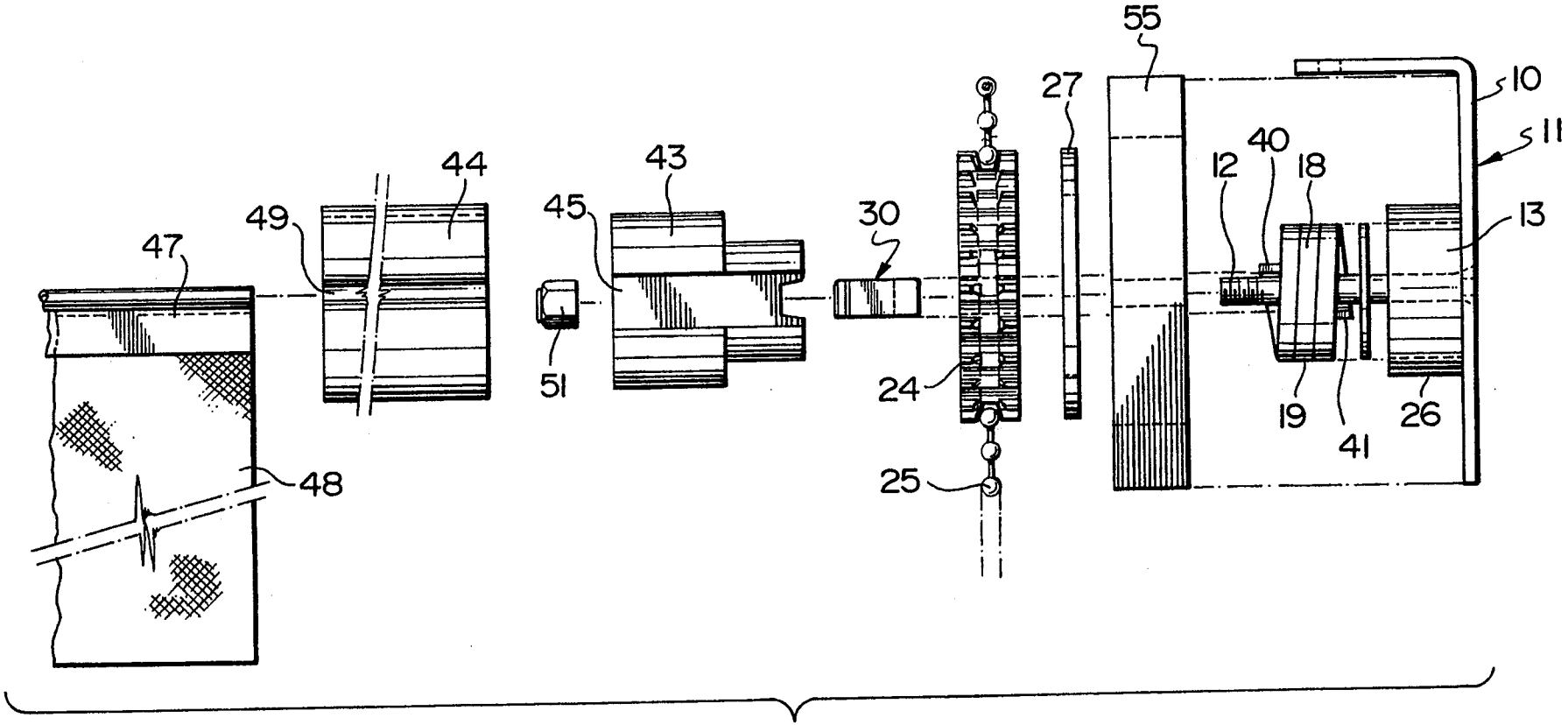
FIG. 1 is an exploded side elevation view of a device constituting a preferred embodiment of the invention.
Figure 2:
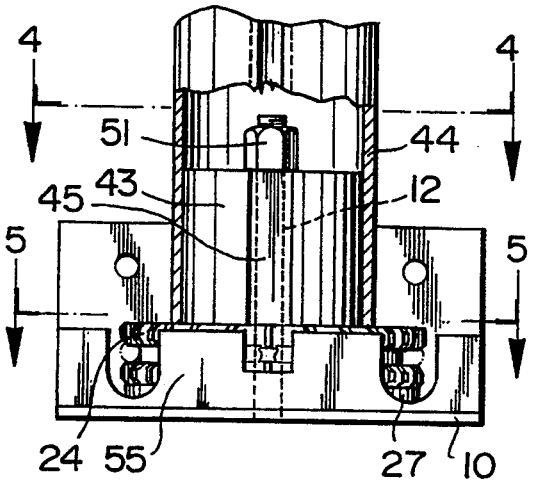
FIG. 2 is a partial view of the assembled device as seen from the underside of FIG. 1.
Figure 3:
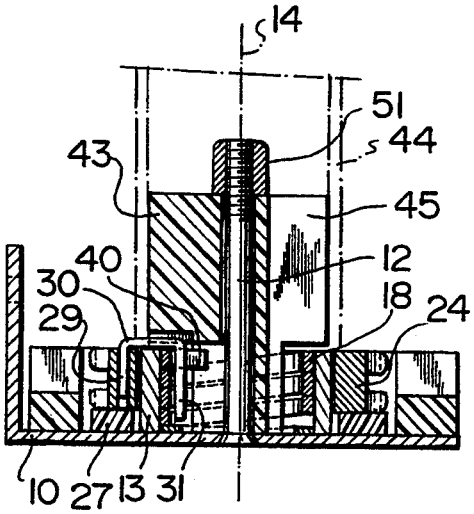
FIG. 3 is a section on the line 3—3 in FIG. 4.

The device illustrated in the drawings consists of an L-shaped base plate or mounting bracket 10 that constitutes the basic element of a support structure 11. A cylindrical post or axle 12 is secured at a generally central location on the main portion of the base plate 10 to project perpendicularly therefrom. A cylindrical bushing 13 is also secured to the base plate 10 around the post 12, the post 12 and bushing 13 being coaxial with each other and together defining a basic rotational axis 14 of the device. The post 12 projects further from the plate 10 than does the bushing 13.

A helical spring 18, the convolutions of which have a generally rectangular cross-section, is located within the bushing 13. As a result of its shape the spring 18 has a substantially cylindrical outer surface 19 of such a diameter that, in the normal condition of the spring, such surface is in contact with the inner cylindrical surface 20 of the bushing 13. A washer 21 is located between the spring 18 and the base plate 10.

A chain wheel 24 manually operable by a chain 25 is rotatably mounted on the base plate 10 around the outer cylindrical surface 26 of the bushing 13. There is a flat washer 27 between the plate 10 and the wheel 24. The wheel 24 has a slot 28 in which there is inserted one arm 29 of a U-shaped link 30, the other arm 31 of which projects into a space S within the spring 18. The spring 18 has a pair of inturned projections 40 and 41 located at its respective ends, which ends overlap one another circumferentially so that the projections 40, 41 define the circumferential edges of the space S. The space S extents for the full longitudinal dimension of the spring and the link arm 31 extends deep enough into this space to be able to engage either of these projections 40 and 41 and exert a circumferential force on the engaged end.

In order that the spring 18 should be released from any frictional grip on the bushing 13 surrounding it and hence be free to be rotated about the axis 14, it is necessary to move one of the projections 40, 41 away from the other, since this relative movement of the spring ends away from each other will coil the spring more tightly and hence decrease its external diameter.

Figure 6:
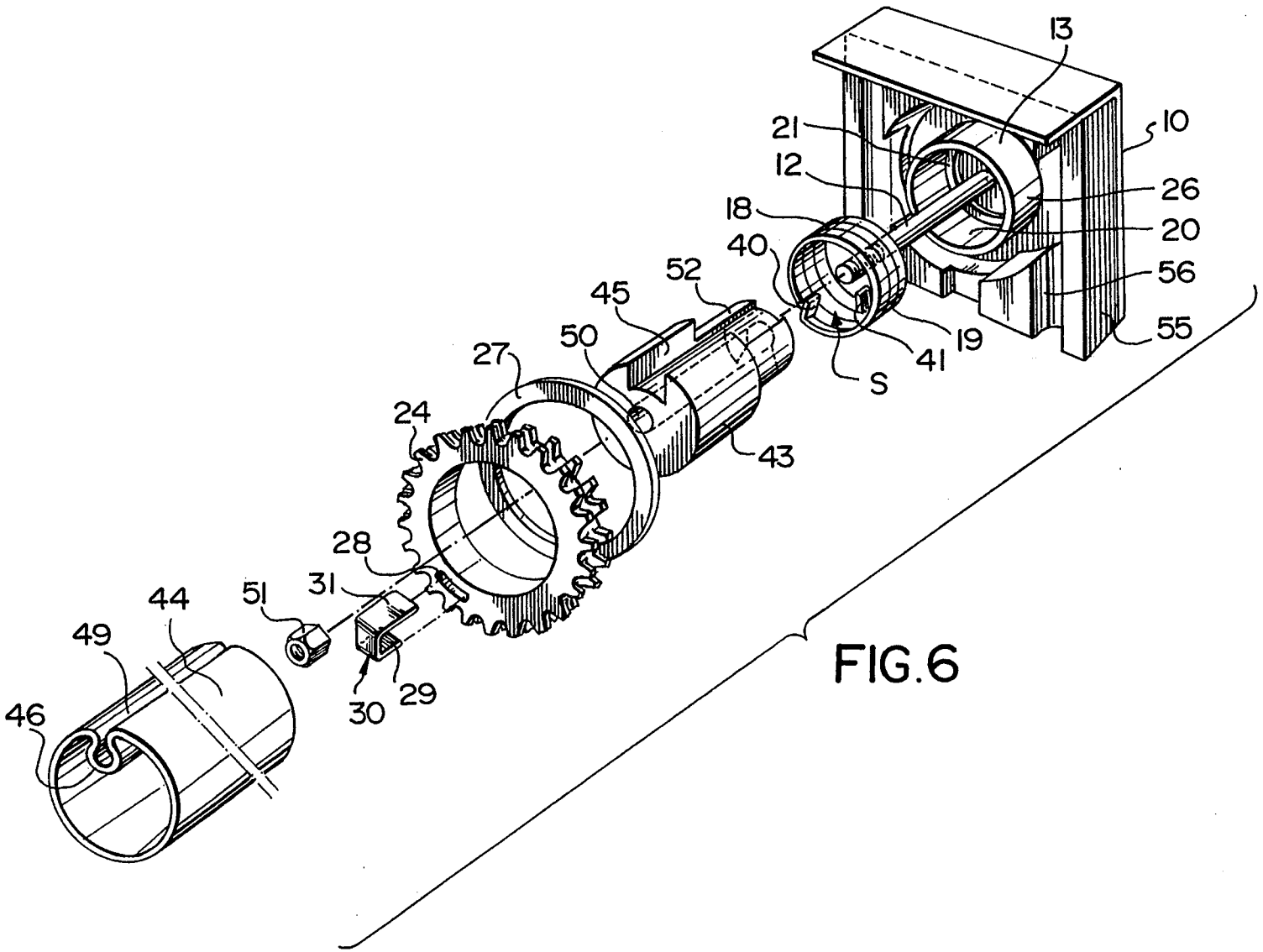
FIG. 6 is an exploded perspective view demonstrating the working of the device.

A generally cylindrical connector 43 connects the spring 18 to a roller 44 (FIGS. 1 and 6) for rotation therewith, a slot 45 in one side of the connector 43 slidingly receiving an inward spline 46 on the roller 44. The roller 44 is arranged to receive a bead 47 on the upper end of a shade 48 in a groove 49 formed in the outer surface of the roller 44. The connector 43 has an axial bore 50 by which it is mounted on the post 12, these parts being held together by a nut 51 on a threaded outer end of the post 12.

Figure 4:
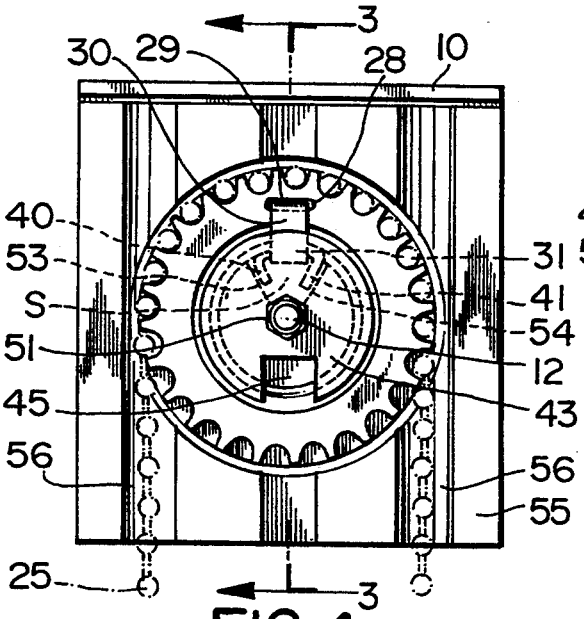
FIG. 4 is a section on the line 4—4 in FIG. 2 with some parts omitted.
Figure 5:
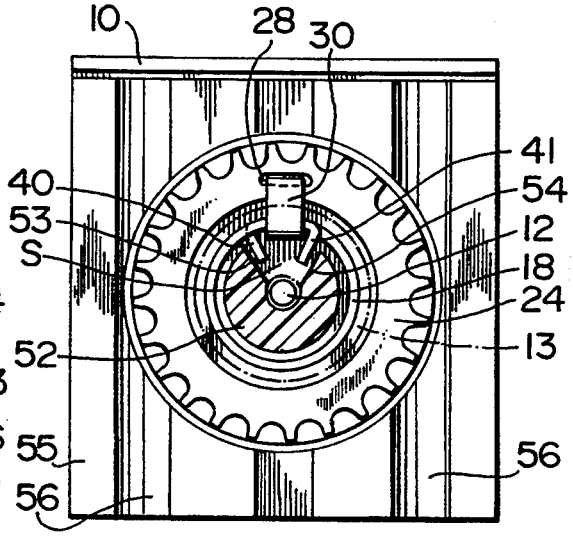
FIG. 5 is a section on the line 5—5 in FIG. 2.

The connector 43 also has a portion 52 that projects into the cavity within the spring 18, this portion having surfaces 53, 54 that, as best seen in FIGS. 4 and 5, are located to engage respective ones of the projections 40, 41 from locations that are circumferentially outside the projections, i.e. away from the space S that is defined between them. If the connector 43 is subjected to a torque from the roller 44 in either direction, one or other of the surfaces 53 or 54 will be brought to bear on its adjacent projection 40 or 41 to tend to move such adjacent projection towards the other projection. This movement tends to coil the spring less tightly and hence to increase its external diameter. Any appreciable such increase will be prevented by the bushing 13 surrounding the spring, but sufficient frictional resistance between the bushing and the spring will be set up in this way to prevent the spring (and hence the connector 43 and the roller 44) from rotating.

The assembly includes a block 55 mounted on the base plate 10 and having lateral grooves 56 for passage of the chain 25.

I claim:

1. A shade operator comprising:

(a) a support structure and a bushing secured to said structure, said bushing having an inner cylindrical surface defining a longitudinal axis, (b) a helical spring coaxially located within the bushing and having a substantially cylindrical outer surface of such diameter as to be in contact with the inner surface of the bushing, the spring having a pair of opposite ends circumferentially movable relatively to each other selectively either to decrease or to tend to increase the diameter of the spring, (c) manually operable means for exerting a torque on the spring about said longitudinal axis and for simultaneously acting on a spring end to decrease the spring diameter and hence avoid frictional resistance by the bushing to rotation of the spring, and (d) means for connecting a shade roller to the spring to rotate therewith upon operation of the manually operable means, said connecting means further including means responsive to a torque from the roller for acting on a spring end to tend to increase the spring diameter to establish a frictional resistance by the bushing to rotation of the spring and hence of the connecting means, (e) wherein each spring end has a projection extending inwardly into a generally cylindrical cavity within the spring, the projections overlapping each other circumferentially to define a circumferentially extending space between them that also extends longitudinal of the spring, (f) said manually operable means including an operating member that surrounds the bushing and is manually rotatable about the axis of the bushing, and a link having a first arm connected to the operating member and a second arm extending into said space between the projections whereby rotation of the operating member in either direction will cause the second arm to act on one of the projections to move it away from the other projection to decrease the spring diameter and simultaneously transmit torque to the spring from the operating member to rotate the spring and the connecting means.

2. A shade operator according to claim 1, wherein (g) the support structure includes a cylindrical post extending along the axis defined by the spring, and (h) the connecting means is mounted for rotation on said post, the connecting means having surfaces for engaging respective ones of the projections so that rotation of the connecting means in either direction will cause one of said surfaces to act on an adjacent projection to tend to move it towards the other projection and hence tend to increase the spring diameter and establish said frictional resistance between the bushing and the spring.

3. A shade operator according to claim 1, wherein said operating member is a tooth wheel turnable by a ball chain.

* * * * *